US007719488B2

(12) United States Patent
Kim

(10) Patent No.: US 7,719,488 B2
(45) Date of Patent: May 18, 2010

(54) SET-UP VOLTAGE GENERATING CIRCUIT AND PLASMA DISPLAY PANEL DRIVING CIRCUIT USING SAME

(75) Inventor: Tae Hyung Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 1108 days.

(21) Appl. No.: 11/367,425

(22) Filed: Mar. 6, 2006

(65) Prior Publication Data

US 2006/0202916 A1 Sep. 14, 2006

(30) Foreign Application Priority Data

Mar. 9, 2005 (KR) ..... 10-2005-0019452

(51) Int. Cl.
*G09G 3/28* (2006.01)

(52) U.S. Cl. ..... 345/63; 345/60; 345/204; 345/55

(58) Field of Classification Search ..... 345/63, 345/60, 204, 55
See application file for complete search history.

(56) References Cited

U.S. PATENT DOCUMENTS 6,552,397 B1 * 4/2003 Chi ..... 257/347
6,963,174 B2 * 11/2005 Lee et al. ..... 315/169.3

* cited by examiner

*Primary Examiner*—Richard Hjerpe
*Assistant Examiner*—Leonid Shapiro
(74) *Attorney, Agent, or Firm*—KED & Associates, LLP

(57) ABSTRACT

A set-up voltage generating circuit for a plasma display panel (PDP) is disclosed. The circuit is capable of generating a set-up voltage by way of a method of charging a predetermined capacitor using a sustain voltage Vs without recourse to a DC/DC converter in forming a set-up voltage necessary for a set-up period of the PDP. As a result, the circuit is simple in its structure and a manufacturing cost thereof can be reduced because there is no need for a DC/DC converter for supplying a set-up voltage.

18 Claims, 7 Drawing Sheets

SET-UP VOLTAGE GENERATING CIRCUIT AND PLASMA DISPLAY PANEL DRIVING CIRCUIT USING SAME

This application claims priority to an application filed in the Korean Industrial Property Office on Mar. 9, 2005, and assigned serial No. 10-2005-0019452 (DIS04-356), the contents of which are incorporated herein by reference.

BACKGROUND OF THE INVENTION

This description relates to a set-up voltage generating circuit and a plasma display panel (PDP) driving circuit using same configured to generate a set-up voltage by way of a method of charging a predetermined capacitor using a sustain voltage Vs without recourse to a DC/DC converter in forming a set-up voltage necessary for a set-up period of the PDP.

Recently, Plasma Display Panels (PDPs) have gained popularity as the next generation flat display devices. The PDPs are applied to various fields such as wall hanging televisions, displays for home theaters and monitors for work stations because they can be excellently implemented with a large dimension screen and a thin profile.

A driving apparatus for a color three-electrode Alternating Current (AC) surface discharge PDP will be briefly described with reference to FIG. 1.

Referring to FIG. 1, the three-electrode AC surface discharge PDP 11 in the related art includes Y electrodes Y1 through Ym, Z electrodes Z1 through Zm, each alternatively arranged one at a time and in parallel. The Y electrodes (Y1~Ym) and the Z electrodes (Z1~Zm) are respectively referred to as scan electrodes and common electrodes.

Furthermore, address electrodes A1 through Ak are arranged, being orthogonal to the respective Y electrodes and the Z electrodes with a predetermined space formed therebetween.

A cell is formed at every intersection between Y electrodes Y1 through Ym and the address electrodes A1 through Ak. Through the structure thus mentioned, a screen is constructed in such a manner that the cells are formed displaying any one of R (red), G (green) and B (blue) at each intersection arranged in a matrix.

Referring again to FIG. 1, a Y driving unit 12 supplies sustain pulses and scan pulses to each Y electrode Y1 through Ym, each corresponding to the Y electrodes of the PDP 11.

A Z driving unit 13 supplies sustain pulses and scan pulses to each Z electrodes Z1 through Zm, each corresponding to the Z electrodes of the PDP 11. An address driving unit 14 supplies writing pulses to each address electrode A1 through Ak, each corresponding to the address electrodes A1 through Ak of the PDP 11.

A controller 15 serves to digitalize an analog image inputted from outside, outputting a digital image, and generates various control signals in response to control signals inputted from outside including clocks, horizontal synchronous signals (HS) and vertical synchronous signals (VS) to thereby control the Y driving unit 12, the Z driving unit 13 and the address driving unit 14.

FIG. 2 is a driving circuit diagram of a Y driving unit according to the prior art and FIG. 3 is a waveform diagram illustrating each terminal voltage of a PDP.

Now, a driving circuit 200 of a Y driving unit of the PDP according to the prior art will be described with reference to FIGS. 1 through 3.

First, a graph Y denotes an output of the Y driving unit 12, a graph Z represents an output of the Z driving unit 13, and a graph X shows an output of the address driving unit 14. The driving circuit 200 is included in the Y driving unit 12, and description will be centered on the graph Y out of the graphs of FIG. 3.

Transistor Q5 and Q3 are turned on during a setup period (a) in FIG. 3, and a sustain voltage Vs is supplied from an energy retrieve circuit 23.

The sustain voltage Vs supplied from the energy retrieve circuit 23 is supplied to each Y electrode Y1 through Ym via an internal diode of the transistor Q3, a transistor Q4 and a transistor Q9 of a scan integral circuit (IC) 22. As a result, the voltage of the Y electrodes Y1 through Ym abruptly rises to the sustain voltage Vs, as shown in a setup period (a) of FIG. 3. At this time, the scan IC 22 functions to directly apply a wave voltage generated in response to an operation of the driving circuit 200 to any one electrode of the Y electrodes Y1 through Ym of the panel 11.

Meanwhile, a drain terminal of the transistor Q5 is applied with a set-up voltage Vsetup. The transistor Q5 whose channel width is adjusted by a variable resistor VR1 increases a voltage of a node N1 to a predetermined slope to raise the voltage to the set-up voltage Vsetup. Consequently, the driving circuit 200 supplies the set-up voltage during the set-up period (a). The set-up voltage is supplied to each Y electrodes Y1 through Ym via the transistor Q9 of the scan IC 22 and the transistor Q4. The Y electrodes Y1 through Ym are applied with a rising ramp waveform ramp-up.

After each Y electrode Y1 through Ym is applied with a rising ramp waveform ramp-up, the transistor Q5 is turned off. Once the transistor Q5 is turned off, only the sustain voltage Vs supplied to the energy retrieve circuit 23 is applied to the node N1, and as a result, each Y electrode Y1 through Ym abruptly falls to the sustain voltage Vs.

Henceforth, the transistor Q4 is turned off at a set-down period (b) illustrated in FIG. 3, and a transistor Q6 is simultaneously turned on. The transistor Q6 is adjusted at a channel width thereof by a variable resistor VR2 and the voltage of node N2 falls by a predetermined slope up to a set-down voltage −Vy. At this time, a falling ramp waveform Ramp-down is applied to each Y electrode Y1 through Ym.

The transistor Q4 is disposed with an internal diode having a direction different from that of the transistor Q3 to prevent the voltage applied to the node N2 from being supplied to a base potential GND via the internal diode of the transistor Q3 and the internal diode of a transistor Q2.

Transistors Q10 and Q11 supplies a scan reference voltage Vsc to the Y electrodes Y1 through Ym (not scanned in the scan process) in an address period.

Meanwhile, the set-up voltage Vsetup is generally higher than the sustain voltage Vs. In order to generate the sustain voltage Vs, a DC/DC converter 21 was used with a sustain voltage Vs at the primary side. In other words, the set-up voltage Vsetup is always higher than the sustain voltage Vs, such that the DC/DC converter 21 was used to generate the set-up voltage Vsetup by way of the sustain voltage Vs.

SUMMARY

In one general aspect, a set-up voltage generating circuit and a plasma display panel (PDP) driving circuit using same are provided to generate a set-up voltage by way of a method of charging a predetermined capacitor using a sustain voltage (Vs) without recourse to a DC/DC converter in forming a set-up voltage necessary for a set-up period of the PDP.

In accordance with one object of the present invention, there is provided a set-up voltage generating circuit. The set-up voltage generating circuit creates a set-up voltage Vsetup and supplies it to a predetermined electrode of the PDP.

The set-up voltage generating circuit includes a charging unit and a first switch, the charging unit connected in series between a terminal applied with a sustain voltage Vs and a terminal having a predetermined voltage and for charging a voltage corresponding to a difference between the sustain voltage Vs and the predetermined voltage and for supplying the charged voltage to the set-up voltage Vsetup, and the first switch connected in series between the charging unit and the terminal having the predetermined voltage and for controlling the charge of the charging unit in response to a predetermined control signal.

The predetermined voltage may be a voltage having a negative (−) polarity, or −Vs.

Preferably, the charging unit comprises a device for preventing the charged voltage from being discharged toward the sustain voltage Vs, and the set-up voltage generating circuit further comprises a second switch for being connected in series to the charging unit to supply to the set-up voltage Vsetup a voltage where the charged voltage and the sustain voltage Vs are added, if the charging unit is charged and the first switch is turned off.

The predetermined voltage may be a base potential (Ground).

Preferably, the charging unit may comprise: a diode in which an anode is connected to a terminal applied with the sustain voltage Vs; and a capacitor connected and charged between a cathode of the diode and the first switch.

The first switch may be a transistor, and the transistor is preferred to be a Metal-Oxide-Semiconductor (MOS) device.

In accordance with another embodiment of the present invention, a PDP driving circuit comprises: a set-up voltage generating circuit generating and outputting a set-up voltage Vsetup; and a set-up supplier supplying the set-up voltage Vsetup outputted by the set-up voltage generating circuit to a predetermined electrode of the PDP, wherein the set-up voltage generating circuit comprises: a charger connected in series between a terminal applied with a sustain voltage Vs and a terminal of a predetermined voltage for charging a voltage corresponding to a difference between the sustain voltage Vs and the predetermined voltage and outputting the set-up voltage Vsetup thus generated to the set-up supplier; and a first switch connected in series between the charger and the terminal of the predetermined voltage for controlling the charge of the charger in response to a predetermined control signal.

According to another embodiment of the present invention, a PDP driving circuit may comprise: a scan-up unit outputting a reference voltage Vsc which is a higher level out of two levels of a predetermined scan pulse supplied to a predetermined electrode of the PDP to a predetermined node during a period corresponding to the higher level; a scan-down unit outputting a set-down voltage −Vy which is a lower level of the scan pulse to the node during a period corresponding to the lower level; and a scan Integrated Circuit (IC) providing to the predetermined electrode the scan pulse formed by the reference voltage applied to the node during a predetermined address period and the set-down voltage to the predetermined electrode, and providing to the predetermined electrode a set-up voltage Vsetup outputted from the set-up supplier during a predetermined set-up period.

The charger may comprise: a diode whose terminal applied with the sustain voltage Vs is connected with an anode; and a capacitor charged by being connected between a cathode of the diode and the first switching device, and the set-up supplier may comprise a third switch adjusting the amount of current flowing between the cathode of the diode and the predetermined electrode to adjust in such a manner that the set-up voltage Vsetup having a predetermined slope can be applied to the predetermined electrode.

In another general aspect, a display apparatus disposed with a PDP comprises a PDP driving circuit for displaying in such a manner that an image corresponding to a predetermined image signal can be visually recognized.

BRIEF DESCRIPTION OF THE DRAWINGS

The above and other objects, advantages, and features of the present invention will be more apparent from the following description taken in conjunction with the accompanying drawings in which.

DESCRIPTION OF THE PREFERRED EMBODIMENTS

Best modes of carrying out the present invention will be described in further detail using various embodiments with reference to the accompanying drawings.

Figure 4:
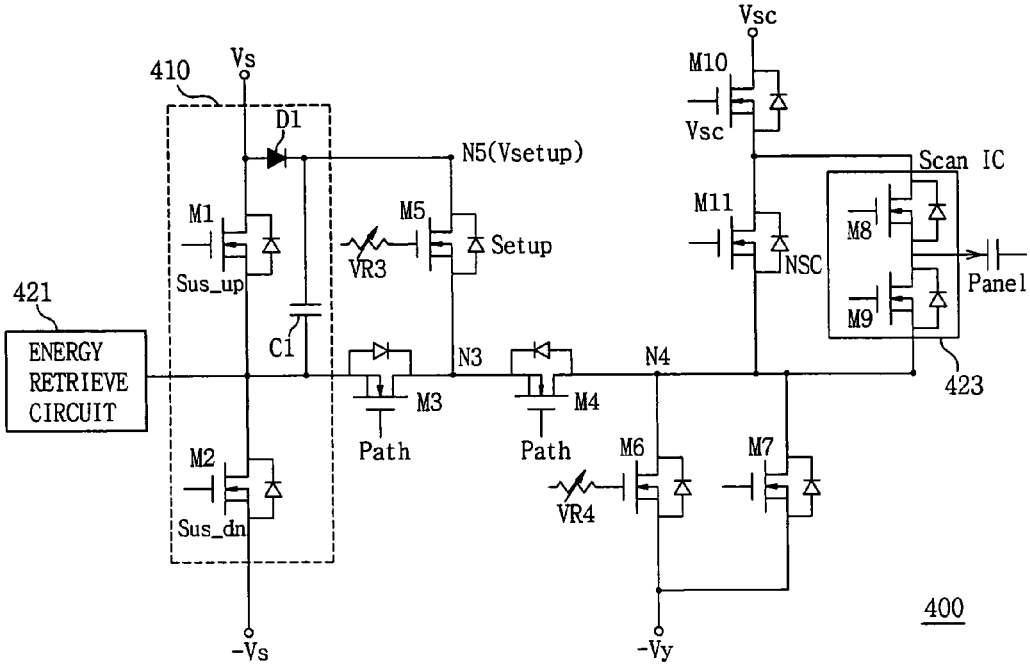
FIG. 4 is a PDP driving circuit diagram including a set-up voltage generating circuit according to one embodiment of the present invention.

FIG. 4 is a driving circuit diagram of a PDP including a set-up voltage generating circuit according to one embodiment of the present invention.

The set-up generating circuit according to one embodiment of the present invention may be included in a driving circuit for PDP, or further may be included in the PDP.

Figure 1:
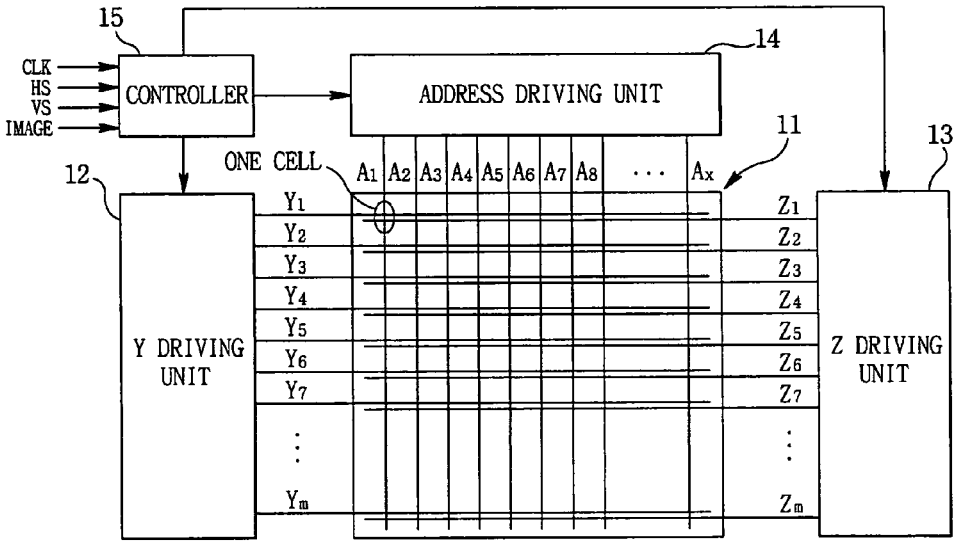
FIG. 1 (PRIOR ART)
FIG. 1 is a block diagram of a PDP driving apparatus.
Figure 2:
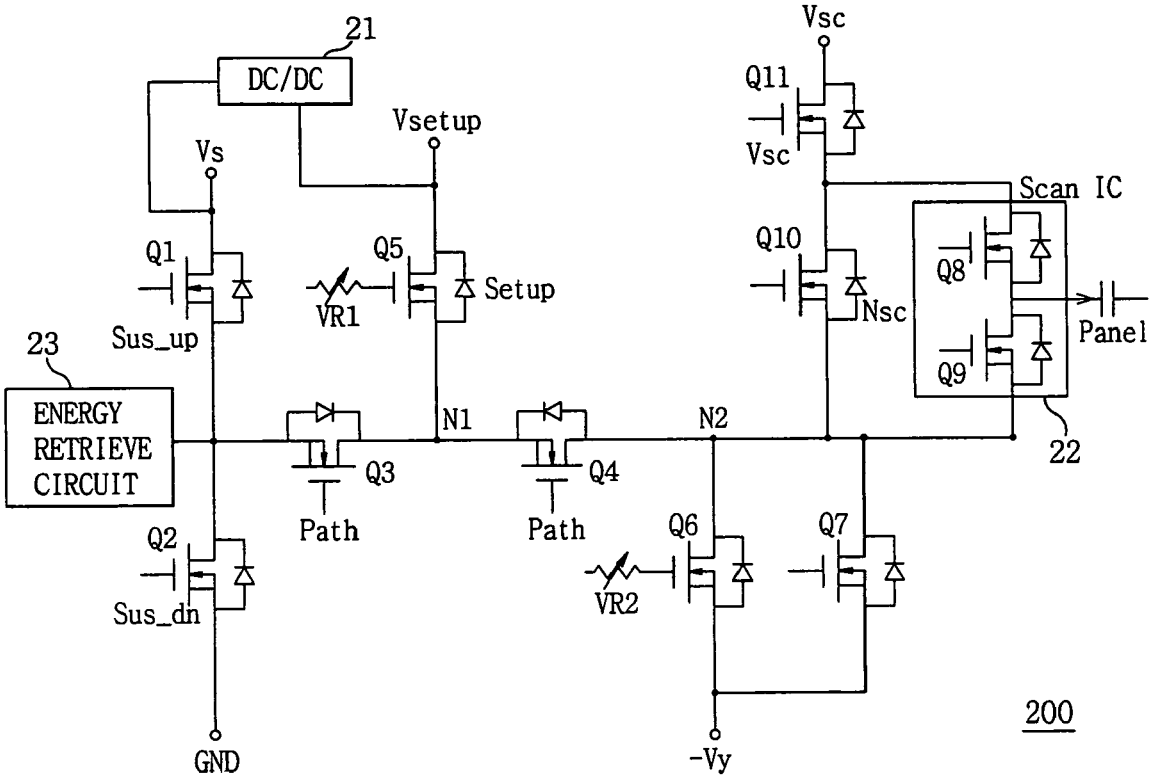
FIG. 2 (PRIOR ART)
FIG. 2 is a driving circuit diagram of a Y driving unit according to the prior art.
Figure 3:
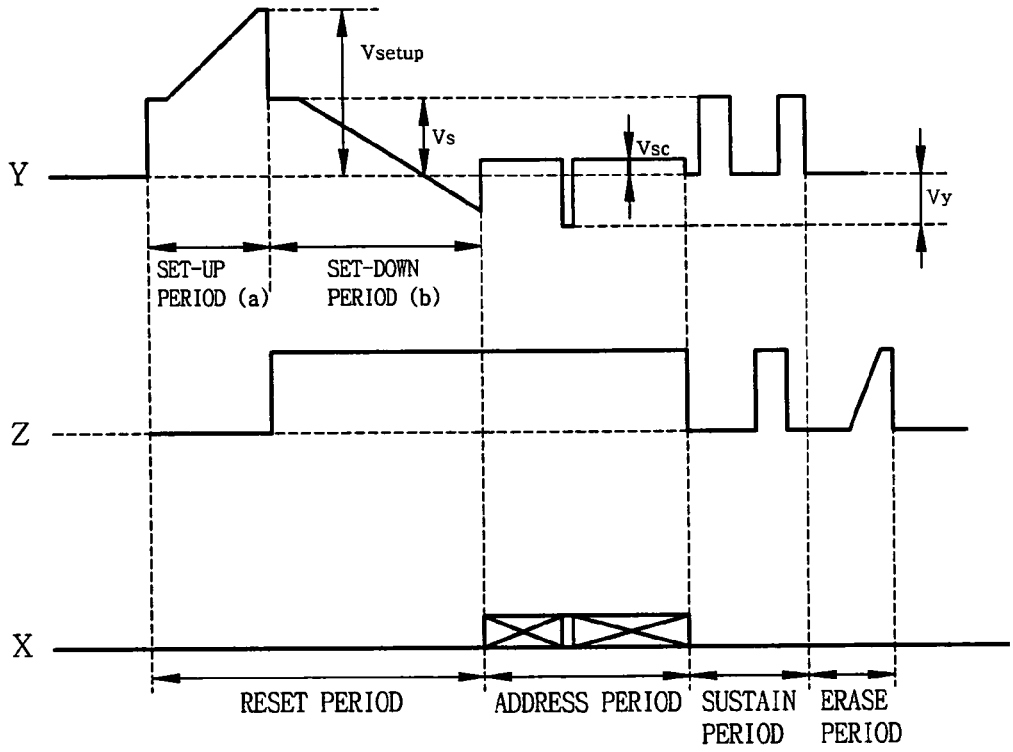
FIG. 3 is a waveform diagram illustrating each terminal voltage of a PDP.

Basically, FIGS. 1 and 3 are applied in identical conception to the present invention, so that a set-up voltage generating circuit 410 for the PDP according to the present invention will be described with reference to FIGS. 1 and 3.

The driving circuit 400 according to one embodiment of the present invention may be basically included in a Y driving unit 12 of FIG. 1 so constructed as to maintain a base potential (GROUND) or a predetermined bias at the Y electrode of a PDP 11.

The driving circuit 400 according to one embodiment of the present invention include a set-up voltage generating circuit 410, an energy retrieval circuit 421, a scan IC 423, a set-up supplier 425, a scan-up unit 427 and a scan-down unit 429.

Waveform outputted via the Y electrodes Y1 through Ym by the driving circuit 400 according to the embodiment of the present invention is identical to that of FIG. 3.

Furthermore, the set-up voltage generating circuit 400 according to the embodiment of the present invention may be included in a Z driving unit 13 Z1 through Zm and may supply a waveform corresponding to a set-up period (a) and a set-up period (b) of graph Y of FIG. 3.

The driving circuit 400 of FIG. 4 replaces a DC/DC converter including the set-up voltage generating circuit 410 including a capacitor C1. The set-up voltage generating circuit 410 includes transistors M1 and M2, a diode D1 and the capacitor C1, and is connected to power source voltages Va and Vb. The size of the power source voltage Va is the same as that of a sustain voltage Vs, and the applied power source voltage Va supplies the sustain voltage Vs to the driving circuit 400 and simultaneously charges the capacitor C1.

The size of the power source voltage Vb may vary relative to that of a set-up voltage Vsetup. The power source voltage Vb is preferred to be a voltage −Vs which has the same size as that of the sustain voltage Vs but is negative. FIG. 4 illustrates a case where a second power source (not shown) is −Vs.

The diode D1 forms a charging route of the capacitor C1 along with the transistor M2.

Preferably, the transistor M2 is an MOS (Metal-Oxide-Semiconductor) device, and the transistor M2 may be so constructed as to include an internal diode. A source of the transistor M2 is connected to the second power source (not shown), while a drain thereof is connected to the capacitor C1 and the transistor M1.

The transistor M1 is connected in parallel to the capacitor C1 and the diode D1 connected in series. The transistor M1 is not an essential element of the set-up voltage generating circuit 410 according to the embodiment of the present invention, and implements a switching operation at the start of the set-up period (a) for supplying the sustain voltage Vs along with an energy retrieve circuit 421. However, the transistor M1 can operate in such a manner that, in supplying a voltage charged in the capacitor C1 as a set-up voltage Vsetup, the sustain voltage Vs is added to the voltage charged in the capacitor C1 and supplied as the set-up voltage Vsetup.

Figure 5:
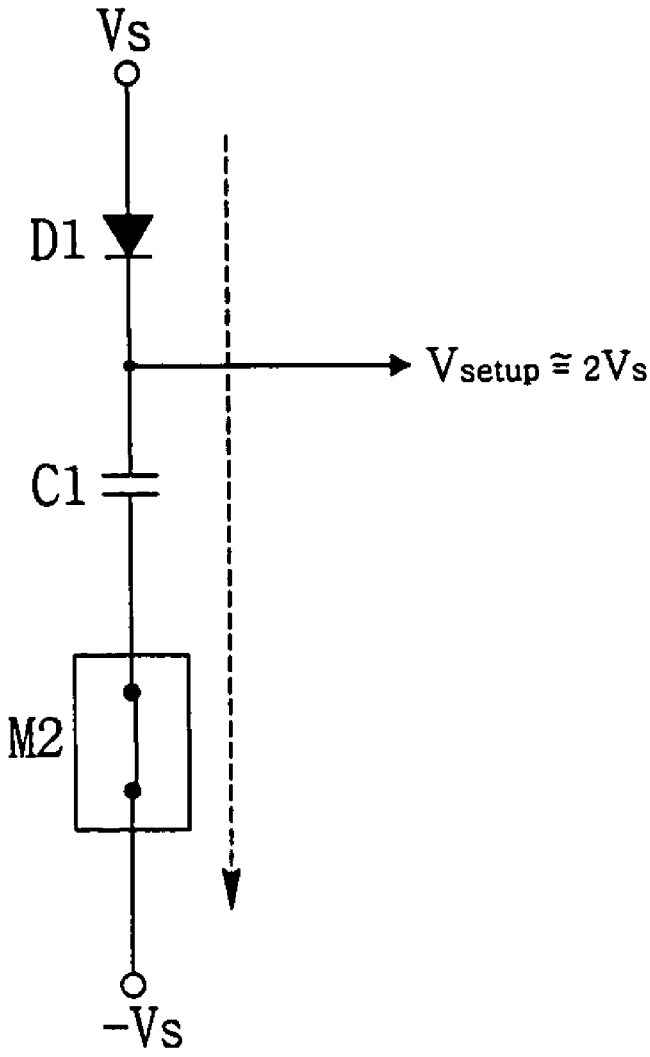
FIG. 5 is a circuit diagram of a set-up voltage generating circuit according to one embodiment of the present invention.

Now, the set-up voltage generating circuit will be described in more detail with reference to FIG. 5, where a charging unit including the diode D1 and the capacitor C1 will be described.

Firs of all, the diode D1 forms a route for charging the capacitor C1. Furthermore, the diode D1 blocks formation of a charging route between the capacitor C1 and the sustain voltage Vs, in supplying the voltage charged in the capacitor C1 as a set-up voltage Vsetup.

The capacitor C1 may be charged through a charging route formed between the sustain voltage Vs and −Vs as the transistor M2 is turned on. If the transistor M2 is turned on, the capacitor C1 is charged up to approximately 2Vs. Consequently, a voltage of node N5 connected to a cathode of the diode D1 out of both nodes of the capacitor C1, becomes a set-up voltage Vsetup of 2Vs.

As the node N5 is connected to a drain of a transistor M5, a drain node of the transistor M5 is supplied with the set-up voltage Vsetup. As a result, the sustain voltage Vs can be appropriately used to supply the set-up voltage Vsetup even if a separate DC/DC converter is not used for supplying the set-up voltage Vsetup.

If the sustain voltage Vs is approximately 200V, and the transistor M1 is turned off, the set-up voltage Vsetup reaches approximately 400V. FIG. 5 illustrates a case where the transistor M1 is turned off, and at this juncture, a waveform in the set-up period (a) may be different from that of FIG. 3.

Again, description is given preferably with reference to FIG. 4.

If the driving circuit 400 according to the embodiment of the present invention is used, the node N5 may be supplied with 400V which is the double of the sustain voltage Vs. When the capacitor C1 is charged, the transistor M1 is turned off.

If the capacitor C1 is charged to 2Vs, and the transistor M1 is turned on, the set-up voltage Vsetup of the node N5 may reach approximately 600V, which is triple the sustain voltage Vs. If the capacitor C1 is charged to 2Vs, the transistor M2 is turned off and the transistor M1 is turned on, the node N5 connected to the capacitor C1 and the sustain voltage Vs is applied with a set-up voltage of approximately 3Vs. Even if the set-up voltage Vsetup is supplied with 600V, the voltage actually supplied to the Y terminals Y1 through Ym is adjusted by the transistor M5, such that the voltage supplied to the Y terminals Y1 through Ym reaches approximately 400V. Consequently, the set-up Vsetup can be defined by the following Equations.

$$Vsetup=(Va-Vb)+Va, \text{ where the transistor } M1 \text{ is turned on.} \quad \text{[Equation 1]}$$

As a result, if Va is Vs, Vb is −Vs and the transistor M1 is turned on, Vsetup reaches 3Vs, and a waveform is identically formed to that of the set-up period (a) of FIG. 3.

$$Vsetup=(Va-Vb), \text{ where the transistor } M1 \text{ is turned off.} \quad \text{[Equation 2]}$$

As a result, if Va is Vs, Vb is −Vs, and the transistor M1 is turned off, the set-up voltage Vsetup is 2Vs. Besides, adjustment of the size of Vb can form various set-up voltages Vsetup.

The set-up supplier 425, the scan-up unit 427 and the scan-down unit 429 are blocked for the convenience of explanation, where a same waveform as that of graph Y of FIG. 3 is outputted to Y electrodes Y1 through Ym.

The set-up supplier 425 supplies to the node N3 the set-up voltage Vsetup supplied to the node N5 from the set-up voltage generating circuit 410. At this time, the transistor M5 is adjusted at its channel by a variable resistor VR3 and the set-up voltage Vsetup supplied to the node N3 is to have a predetermined slope.

The scan-up unit 427 outputs to the scan IC 423 a predetermined scan reference voltage supplied to the Y electrodes Y1 though Ym of the PDP 11 during the address period. That is, the scan-up unit 427 supplies the scan reference voltage Vsc to the Y electrodes Y1 through Ym not scanned during the scanning process via a transistor M8.

The scan-down unit 429 supplies the set-down voltage −Vy to a node N4 during a set-down period (b). At this time, a transistor M6 is adjusted at its channel by a variable resistor VR4, and the set-down voltage −Vy supplied to a node N4 is to have a predetermined slope. Furthermore, the scan-down unit 429 outputs to the scan IC 423 the set-down voltage −Vy supplied to the Y electrodes Y1 through Ym of the PDP during the address period.

The scan IC 423 provides a route through which the sustain voltage Vs and the set-up voltage Vsetup are supplied to the Y electrodes Y1 through Ym. Furthermore, the scan IC 423 switches the scan reference voltage Vsc and the set-down voltage −Vy during the address period so that a scan pulse can be supplied to the Y electrode which is a subject to be scanned.

Figure 6:
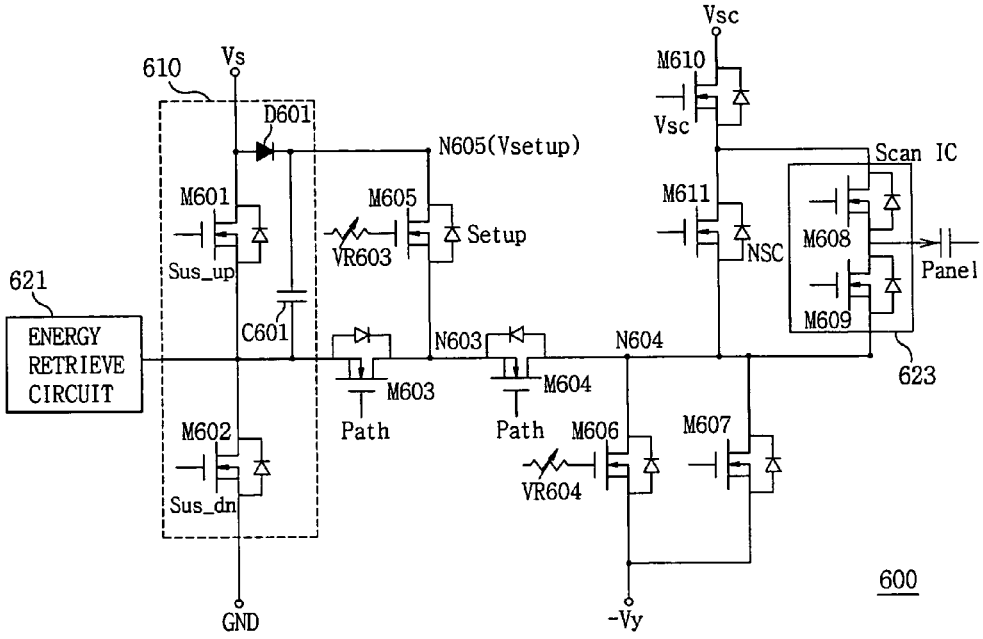
FIG. 6 is a PDP driving circuit diagram including a set-up voltage driving circuit according to another embodiment of the present invention.

FIG. 6 is a driving circuit diagram of a PDP including a set-up voltage driving circuit according to another embodiment of the present invention.

The driving circuit 600 of FIG. 6 basically operates in the same way as that of the driving circuit 400 of FIG. 4 except for a set-up voltage generating circuit 610.

Transistors M603 through M611 of FIG. 6 correspond to transistors M3 through M11 of FIG. 4 and operate likewise. Variable resistors VR603 and VR604 of FIG. 6, and energy retrieve circuit 621 correspond to variable resistors VR3 and VR4, and energy retrieve circuit 421 and operate likewise. A set-up voltage generating circuit 610 of FIG. 6 is where the power source voltage Vb is a base potential.

The set-up voltage supply circuit 610 includes a capacitor C601, a transistor M601 and a diode D601. A capacitor 601 is interconnected between a diode D601 and a transistor M602, and is charged to as much as Vs by the sustain voltage Vs. The diode D1 forms a charging route between the sustain voltage Vs and the capacitor C601.

A transistor M601 is connected in parallel to the diode D601 and the capacitor C601 which are connected in series. The transistor M601 basically conducts a switching operation for supplying the sustain voltage Vs along with the energy retrieve circuit 621 at the start of the set-up period (a), except that the transistor M601 is such that the set-up voltage Vsetup can be supplied where the voltage charged at the capacitor C601 is added to the sustain voltage Vs, in supplying the voltage charged at the capacitor C601 as the set-up voltage Vsetup. Consequently, a node N605 is applied with a voltage of 2Vs.

A transistor M602 is connected at a drain thereof to the transistor M601 and the capacitor C601, and is connected at a source thereof to a base potential (GROUND) to provide a charging route whereby the capacitor C601 can be charged by the voltage Vs.

The transistor M602, like the transistor M2, is turned off after the capacitor C601 is charged with the voltage Vs, such that a drain terminal of the transistor M605 connected to the node N605 is applied with the set-up voltage Vsetup of 2Vs.

As described earlier, the voltage Vb of FIG. 4 may correspond to various voltages including a base potential or negative (−) voltage. If the power source voltage Vb is −Vs, the power source voltage Vb can be easily embodied by making a polarity different from that of the sustain voltage Vs. Furthermore, the size of the set-up voltage Vsetup may be different relative to characteristics of devices comprising a driving circuit or a PDP. If the set-up voltage Vsetup is lower than 2Vs or lower than 3Vs, an appropriate adjustment of the power source voltage Vb can easily form the set-up voltage Vsetup. In this case, the waveform formed to correspond to the set-up period (a) of FIG. 3 may be different from that of FIG. 3, details of which will be explained with reference to FIG. 7.

Figure 7:
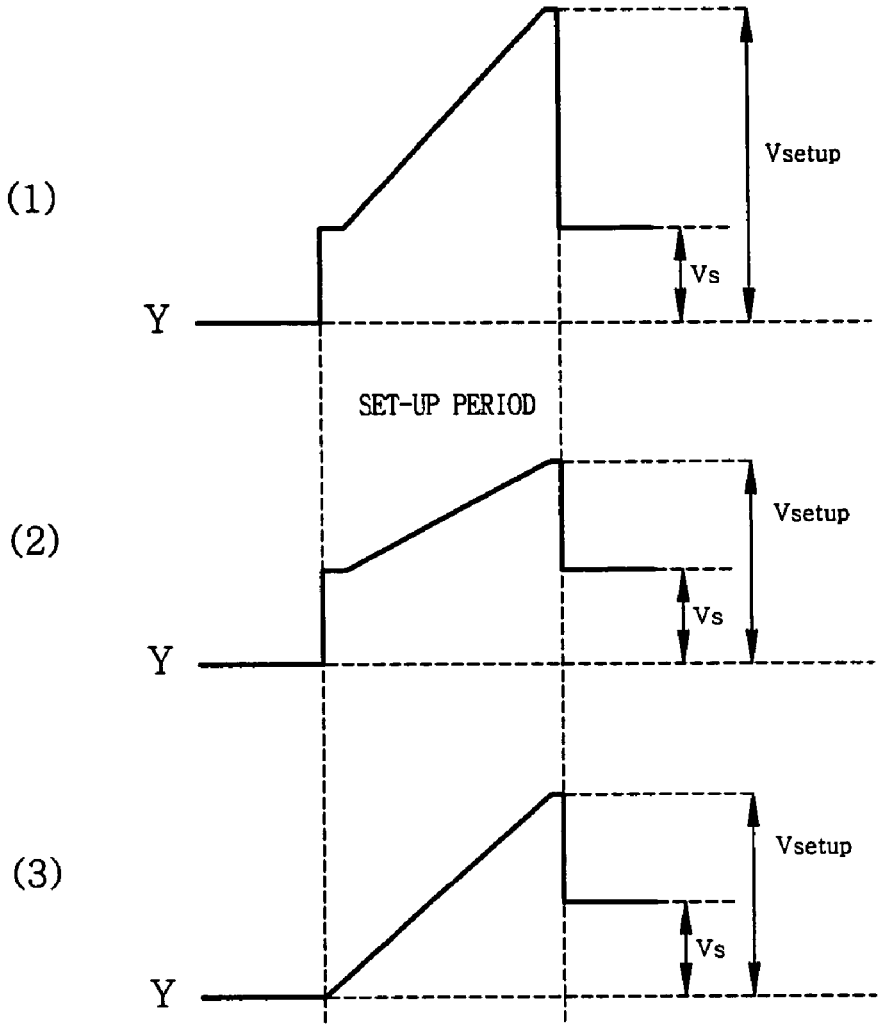
FIG. 7 is a waveform diagram illustrating a Y terminal voltage at a set-up period according to the embodiment of the present invention.

FIG. 7 is a waveform diagram illustrating a Y terminal voltage at a set-up period according to the embodiment of the present invention.

A waveform (1) of FIG. 7 is a case where the transistor M1 is turned on, and the power source voltage Vb is −Vs. A waveform (2) is a case where the transistor M1 is turned on, and the power source voltage Vb is a base potential (GROUND). A waveform (3) is a case where the transistor M1 is turned off, and the power source voltage Vb is −Vs.

The graph (3) shows a case where, because the transistor M1 is turned off, the voltage of the node N3 does not start from the sustain voltage Vs but start from a base potential.

According to another embodiment of the present invention, if a driving apparatus for a PDP according to the present invention is disposed inside the PDP, an interface capable of adjusting the size of a second power source is installed outside to form an optimal set-up voltage in consideration of each device characteristic of the PDP.

Henceforth, an entire operation of the driving circuit 400 according to the embodiment of the present invention will be described with reference to FIGS. 3 and 4.

First, a set-up period (a) starts, and the transistors M5 and M3 are turned on. As a result, the sustain voltage Vs stored in the energy retrieve circuit 421 is supplied to Y terminals Y1 through Ym. The sustain voltage Vs supplied from the energy retrieve circuit 421 is supplied to each scan electrode via the internal diode of the transistor M3, the transistor M4 and the transistor M9 of the scan IC 423. Consequently, voltages of each Y electrode Y1 through Ym abruptly rise to the sustain voltage Vs.

At this time, if the transistor M1 is turned off while the transistor M2 is turned on, the capacitor C1 is charged with approximately 2Vs as explained before. The voltage (approximately 2Vs) charged in the capacitor C1 is thus supplied as the set-up voltage Vsetup as the transistor M2 is turned off.

As another method, if the capacitor C1 is charged with approximately 2Vs, the transistor M1 is turned on, while the transistor M2 is turned off, an approximately 3Vs is supplied as the set-up voltage Vsetup.

The set-up voltage Vsetup is supplied to the node N3 via the transistor M5. The transistor M5 is adjusted at its channel width by the variable resistor VR3 such that the voltage of node N3 is so controlled as to have a predetermined slope to rise up to the set-up voltage Vsetup. The voltage of the node N3 applied with a predetermined slope is supplied to each Y electrode Y1 through Ym via the transistor M4 and the transistor M9 of the scan IC 423. Consequently, each Y electrode Y1 through Ym is supplied with a rising ramp waveform ramp-up.

The transistor M5 is turned off following the application of the rising ramp waveform ramp-up to each Y electrode Y1 through Ym. If the transistor M5 is turned off, only the sustain voltage Vs supplied from the energy retrieve circuit 23 is applied to the node N1, whereby the voltage of each Y electrode Y1 through Ym abruptly falls.

Thereafter, the transistor M4 is turned off while, simultaneously the transistor M5 is turned on in the set-down period. The transistor M6 is adjusted at its channel width by the variable resistor VR4 to lower the voltage of the node N4 to a set-down voltage −Vy at a predetermined slope. Accordingly, each Y electrode Y1 through Ym is supplied with a falling ramp waveform Ramp-down.

At this time, the transistor M4 disposed with a transistor M3 whose internal diode has a different direction prevents formation of a predetermined route from the node N4 to the base potential (GROUND) via the internal diode of the transistor M3 and the energy retrieve circuit 421. Furthermore, the transistors M10 and M11 supply via the transistor M8 a scan base voltage Vsc to an Y electrode which is not scanned during the scan process.

According to the present invention, because a predetermined voltage is charged using a sustain voltage Vs and a capacitor, a sustain voltage Vs and a set-up voltage Vsetup of a different level can be generated and supplied to Y electrodes without recourse to a DC/DC converter.

Furthermore, the set-up voltage generating circuit according to the present invention can simply form an optimal set-up voltage by way of characteristic improvement of devices for the PDP even if the size of the set-up voltage is reduced. As a result, a sustain driving circuit can be manufactured with much ease to thereby enable to lower the price for driving the PDP.

While the above description has pointed out novel features of the invention as applied to various embodiments, the skilled person will understand that various omissions, substitutions, and changes in the form and details of the device or process illustrated may be made without departing from the scope of the invention. Therefore, the scope of the invention is defined by the appended claims rather than by the foregoing description. All variations coming within the meaning and range of equivalency of the claims are embraced within their scope.

What is claimed is:

1. A PDP driving circuit comprising:

a set-up voltage generating circuit generating and outputting a set-up voltage Vsetup; and a set-up supplier supplying the set-up voltage Vsetup outputted by the set-up voltage generating circuit to a predetermined electrode of the PDP, wherein the set-up voltage generating circuit includes:

a charger connected in series between a terminal applied with a sustain voltage Vs and a terminal of a predetermined voltage for charging a voltage corresponding to a difference between the sustain voltage Vs and the predetermined voltage and outputting the set-up voltage Vsetup thus generated to the set-up supplier; and a first switch connected in series between the charger and the terminal of the predetermined voltage for controlling the charge of the charger in response to a predetermined control signal, wherein the charger comprises a device that prevents the charged voltage from being discharged toward the sustain voltage Vs, and the set-up voltage generating circuit further includes a second switch connected to the charger in parallel for controlling in such a manner that a voltage in which the charged voltage and the sustain voltage Vs are added to the set-up voltage Vsetup if the charger is charged and the first switch is turned off.

2. The circuit as defined in claim 1, wherein the predetermined voltage is −Vs.

3. The circuit as defined in claim 1, wherein the predetermined voltage is a base potential (Ground).

4. The circuit as defined in claim 1, wherein the charger further comprises:

a diode whose terminal applied with the sustain voltage Vs is connected with an anode; and a capacitor charged by being connected between a cathode of the diode and the first switch.

5. The circuit as defined in claim 4, wherein the set-up supplier comprises a third switch adjusting the amount of current flowing between the cathode of the diode and the predetermined electrode to adjust in such a manner that the set-up voltage Vsetup having a predetermined slope can be applied to the predetermined electrode.

6. A display apparatus disposed with the PDP of claim 1 comprises a PDP driving circuit for displaying in such a manner that an image corresponding to a predetermined image signal can be visually recognized.

7. The circuit as defined in claim 1, wherein the first switch comprises a transistor.

8. The circuit as defined in claim 7, wherein the transistor comprises a Metal-Oxide-Semiconductor (MOS) device.

9. The circuit as defined in claim 1, wherein the first and second switches are transistors.

10. The circuit as defined in claim 9, wherein the transistor comprises a Metal-Oxide-Semiconductor (MOS) device.

11. A PDP driving circuit comprising:

a set-up voltage generating circuit generating and outputting a set-up voltage Vsetup;

a set-up supplier supplying the set-up voltage Vsetup outputted by the set-up voltage generating circuit to a predetermined electrode of the PDP, wherein the set-up voltage generating circuit includes:

a charger connected in series between a terminal applied with a sustain voltage Vs and a terminal of a predetermined voltage for charging a voltage corresponding to a difference between the sustain voltage Vs and the predetermined voltage and outputting the set-up voltage Vsetup thus generated to the set-up supplier, and a first switch connected in series between the charger and the terminal of the predetermined voltage for controlling a charge of the charger in response to a predetermined control signal;

a scan-up unit outputting a reference voltage Vsc that is a higher level out of two levels of a predetermined scan pulse supplied to a predetermined electrode of the PDP to a predetermined node during a period corresponding to the higher level;

a scan-down unit outputting a set-down voltage−Vy that is a lower level of the scan pulse to the node during a period corresponding to the lower level; and a scan Integrated Circuit (IC) providing to the predetermined electrode the scan pulse formed by the reference voltage applied to the node during a predetermined address period and the set-down voltage to the predetermined electrode, and providing to the predetermined electrode a set-up voltage Vsetup outputted from the set-up supplier during a predetermined set-up period.

12. The circuit as defined in claim 11, wherein the predetermined voltage is −Vs.

13. The circuit as defined in claim 11, wherein the predetermined voltage is a base potential (Ground).

14. The circuit as defined in claim 11, wherein the charger comprises:

a device that prevents the charged voltage from being discharged toward the sustain voltage Vs;

a diode whose terminal applied with the sustain voltage Vs is coupled with an anode; and a capacitor charged by being coupled between a cathode of the diode and the first switch.

15. The circuit as defined in claim 14, wherein the set-up supplier comprises a second switch adjusting an amount of current flowing between the cathode of the diode and the predetermined electrode to adjust in such a manner that the set-up voltage Vsetup having a predetermined slope can be applied to the predetermined electrode.

16. A display apparatus disposed with the PDP of claim 11 comprises a PDP driving circuit for displaying in such a manner that an image corresponding to a predetermined image signal can be visually recognized.

17. The circuit as defined in claim 11, wherein the first switch comprises a transistor.

18. The circuit as defined in claim 17, wherein the transistor comprises a Metal-Oxide-Semiconductor (MOS) device.

* * * * *